US007485193B2

(12) United States Patent
Hirota et al.

(10) Patent No.: US 7,485,193 B2
(45) Date of Patent: Feb. 3, 2009

(54) R-FE-B BASED RARE EARTH PERMANENT MAGNET MATERIAL

(75) Inventors: Koichi Hirota, Echizen (JP); Takehisa Minowa, Echizen (JP)

(73) Assignee: Shin-Etsu Chemical Co., Ltd, Tokyo (JP)

( * ) Notice: Subject to any disclaimer, the term of this patent is extended or adjusted under 35 U.S.C. 154(b) by 163 days.

(21) Appl. No.: 10/589,237

(22) PCT Filed: Jun. 20, 2005

(86) PCT No.: PCT/JP2005/011241

§ 371 (c)(1),
(2), (4) Date: Aug. 14, 2006

(87) PCT Pub. No.: WO2005/123974

PCT Pub. Date: Dec. 29, 2005

(65) Prior Publication Data

US 2007/0157998 A1 Jul. 12, 2007

(30) Foreign Application Priority Data

Jun. 22, 2004 (JP) ..... 2004-183288

(51) Int. Cl.
*H01F 1/053* (2006.01)

(52) U.S. Cl. ..... 148/302; 420/83; 420/121

(58) Field of Classification Search ..... None
See application file for complete search history.

(56) References Cited

U.S. PATENT DOCUMENTS 4,664,724 A * 5/1987 Mizoguchi et al. ..... 148/302

(Continued)

FOREIGN PATENT DOCUMENTS

EP 0 101 552 A2 2/1984

(Continued)

OTHER PUBLICATIONS

Notification of Transmittal of Copies of Translation of the International Preliminary Report on Patentability (Form PCT/IB/338) of International Application No. PCT/JP2005/011241 mailed Jan. 11, 2007 with Forms PCT/IB/373 and PCT/ISA/237.

(Continued)

*Primary Examiner*—John P. Sheehan
(74) *Attorney, Agent, or Firm*—Westerman, Hattori, Daniels & Adrian, LLP.

(57) ABSTRACT

A R—Fe—B base rare earth permanent magnet material consists of, in percents by weight, 25 to 45 wt % of R, 0.1 to 4.5 wt % of Co, 0.8 to 1.4 wt % of B, 0.05 to 3.0 wt % of Al, 0.02 to 0.5 wt % of Cu, 0.03 to 0.5 wt % of M, 0.01 to 0.5 wt % of C, 0.05 to 3.0 wt % of O, 0.002 to 0.1 wt % of N, 0.001 to 2.0 wt % of F, with the balance of Fe and incidental impurities, wherein R is at least one element selected from among Nd, Pr, Dy, Tb and Ho, and M is at least one element selected from among Zr, Hf, Ti, Cr, Nb, Mo, Si, Sn, Zn, V, W and Cr.

6 Claims, 2 Drawing Sheets

U.S. PATENT DOCUMENTS

| | | | | |
|---|---|---|---|---|
| 5,162,064 | A * | 11/1992 | Kim et al. | 148/302 |
| 5,437,741 | A | 8/1995 | Ozaki et al. | |
| 5,447,578 | A | 9/1995 | Ozaki et al. | |
| 6,080,245 | A * | 6/2000 | Uchida et al. | 148/103 |
| 6,296,720 | B1 * | 10/2001 | Yamamoto et al. | 148/302 |
| 2003/0106615 | A1 | 6/2003 | Hirota et al. | |
| 2004/0187962 | A1 * | 9/2004 | Ishizaka et al. | 148/101 |
| 2005/0067058 | A1 * | 3/2005 | Fujimori et al. | 148/302 |

FOREIGN PATENT DOCUMENTS

| | | | |
|---|---|---|---|
| EP | 0 106 948 | A2 | 5/1984 |
| EP | 0 124 655 | A2 | 11/1984 |
| EP | 1 275 741 | A1 | 1/2003 |
| JP | 59-64733 | A | 4/1984 |
| JP | 59-132104 | A | 7/1984 |
| JP | 60-176203 | A | 9/1985 |
| JP | 2675430 | B2 | 11/1987 |
| JP | 62-291903 | A | 12/1987 |
| JP | 63-128606 | A | 6/1988 |
| JP | 1-219143 | A | 9/1989 |
| JP | 11-251125 | A | 9/1999 |
| JP | 3009687 | B2 | 2/2000 |
| JP | 2003-113429 | A | 4/2003 |
| JP | 2003-282312 | A | 10/2003 |

OTHER PUBLICATIONS

International Search Report of PCT/JP2005/011241, date of mailing: Sep. 27, 2001.

* cited by examiner

R-FE-B BASED RARE EARTH PERMANENT MAGNET MATERIAL

TECHNICAL FIELD

This invention relates to a R—Fe—B base rare earth permanent magnet material having dramatically improved magnetic properties.

BACKGROUND ART

Due to excellent magnetic properties and economy, rare earth permanent magnets are on widespread use in the field of electric and electronic equipment. In these years there is an increasing demand for them, with further enhancement of their properties being desired. Of the rare earth permanent magnets, R—Fe—B base rare earth permanent magnets are quite excellent permanent magnet materials, as compared with rare earth-cobalt base magnets, in that Nd which is one of predominant elements is richer in resource than Sm, and their magnetic properties surpass those of rare earth-cobalt base magnets. They are also advantageous in economy in that the majority is constituted by inexpensive Fe.

The R—Fe—B base permanent magnets, however, have problems that (1) the magnets themselves are liable to rust due to high iron contents and require certain surface treatment and (2) their use in a high-temperature environment is difficult due to a low Curie point.

Heretofore, for achieving further improvements in magnetic properties of R—Fe—B base permanent magnets and alleviating the above problems, attempts have been made to add a variety of elements thereto. For instance, there were proposed magnet materials having Ti, Ni, Bi, V or the like added for providing stable coercive force (see JP-A 59-64733 and JP-A 59-132104); magnet materials having Te, Zn, Se or the like added for improving coercive force (see JP-A 60-176203); magnet materials having 0.02 to 0.5 at % of Cu added for optimizing heat treatment conditions (see JP-A 1-219143); magnet materials in which Fe is substituted with Co and Ni in a high concentration for improving corrosion resistance (see Japanese Patent No. 2,675,430); and magnet materials having rare earth oxide $R'_mO_n$ (wherein R' is Y, La, Pr, Nd, Sm, Eu, Gd, Tb, Dy, Ho, Er, Tm, Yb or Lu) added thereto for reducing the cost and improving coercive force and resistivity (see JP-A 11-251125).

Gasifiable elements such as oxygen and carbon are generally considered as impurities to be excluded because they are believed to consume excess rare earth elements localized in the grain boundary phase and thus detract from magnetic properties. For this reason, several proposals have been made for minimizing the contamination of such gas impurities, including the method to prevent the magnet alloy or powder from these elements during the manufacturing process, to use the high purity raw materials, and the method of removing the impurity elements entrained with the raw materials out of the system.

DISCLOSURE OF THE INVENTION

Problems to Be Solved by the Invention

An object of the invention is to provide a R—Fe—B base rare earth permanent magnet material having dramatically improved magnetic properties.

MEANS FOR SOLVING THE PROBLEM

Making extensive investigations to solve the above problems, the inventors have found that an appropriate amount of fluorine added to a R—Fe—B base permanent magnet forms a R—O—F compound (wherein R is one or more of Nd, Pr, Dy, Tb and Ho, O is oxygen, and F is fluorine) which is localized at triple points in the magnet; and that the R—O—F compound, when finely dispersed in the magnet, is effective for restraining primary phase grains from abnormally growing during the sintering process of the R—Fe—B permanent magnet materials, thereby increasing the coercive force of the R—Fe—B permanent magnet material. The present invention is predicated on this finding.

Briefly stated, the present invention provides a R—Fe—B base rare earth permanent magnet material consisting of, in percents by weight, 25 to 45 wt % of R, 0.1 to 4.5 wt % of Co, 0.8 to 1.4 wt % of B, 0.05 to 3.0 wt % of Al, 0.02 to 0.5 wt % of Cu, 0.03 to 0.5 wt % of M, 0.01 to 0.5 wt % of C, 0.05 to 3.0 wt % of O, 0.002 to 0.1 wt % of N, 0.001 to 2.0 wt % of F, with the balance of Fe and incidental impurities, wherein R is at least one element selected from the group consisting of Nd, Pr, Dy, Tb and Ho, and M is at least one element selected from the group consisting of Zr, Hf, Ti, Cr, Nb, Mo, Si, Sn, Zn, V, W and Cr.

BENEFITS OF THE INVENTION

The present invention permits a R—Fe—B base rare earth permanent magnet material having an improved coercive force and excellent squareness to be manufactured in a consistent manner and is of great worth in the industry.

BEST MODE FOR CARRYING OUT THE INVENTION

Figure 1:
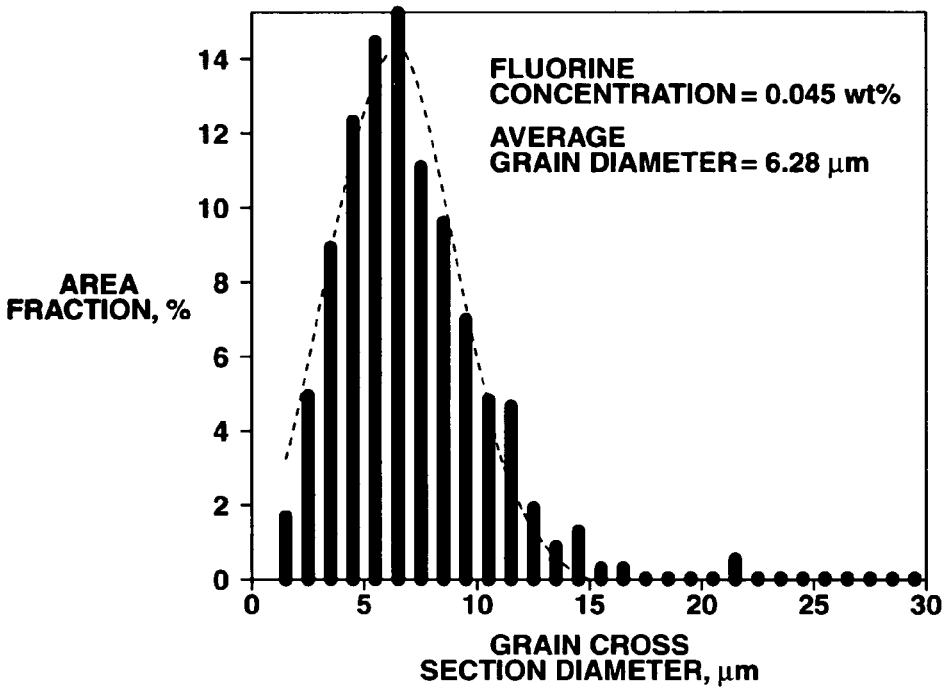
FIG. 1 is a diagram showing the grain size distribution of a R—Fe—B base magnet having 0.045 wt % of fluorine.

The R—Fe—B base rare earth permanent magnet material of the present invention consists of, in percents by weight, R 25 to 45 wt %,
Co 0.1 to 4.5 wt %,
B 0.8 to 1.4 wt %,
Al 0.05 to 3.0 wt %,
Cu 0.02 to 0.5 wt %,
M 0.03 to 0.5 wt %,
C 0.01 to 0.5 wt %,
O 0.05 to 3.0 wt %,
N 0.002 to 0.1 wt %,
F 0.001 to 2.0 wt %, with the balance of Fe and incidental impurities, wherein R is at least one element selected from among Nd, Pr, Dy, Tb and Ho, and M is at least one element selected from among Zr, Hf, Ti, Cr, Nb, Mo, Si, Sn, Zn, V, W and Cr.

R used in the R—Fe—B base rare earth permanent magnet material of the invention is one or more elements selected from among neodymium (Nd), praseodymium (Pr), dysprosium (Dy), terbium (Tb) and holmium (Ho).

Herein, the amount of R (one or more elements selected from among Nd, Pr, Dy, Tb and Ho) is limited to the range of 25 to 45 wt % based on the weight of the permanent magnet material because less than 25 wt % of R leads to a considerable reduction in coercive force and more than 45 wt % of R leads to a considerable reduction in remanence (residual magnetic flux density). The amount of R prefer to be 28 to 32 wt %.

The amount of B is limited to the range of 0.8 to 1.4 wt % because less than 0.8 wt % of B leads to a considerable reduction in coercive force and more than 1.4 wt % of B leads to a considerable reduction in remanence. The amount of B prefer to be 0.85 to 1.15 wt %.

Al is effective for increasing coercive force at a low cost. The amount of Al is limited to the range of 0.05 to 3.0 wt % because less than 0.05 wt % of Al is less effective for increasing coercive force and more than 3.0 wt % of Al leads to a decrease in remanence. The amount of Al prefer to be 0.08 to 1.5 wt %.

The amount of Cu is limited to the range of 0.02 to 0.5 wt % because less than 0.02 wt % of Cu is less effective for increasing coercive force and more than 0.5 wt % of Cu leads to a decrease in remanence. The amount of Cu prefer to be 0.02 to 0.3 wt %.

M, which is one or more elements selected from among Zr, Hf, Ti, Cr, Nb, Mo, Si, Sn, Zn, V, W and Cr is effective for increasing coercive force among other magnetic properties. The amount of M is limited to the range of 0.03 to 0.5 wt % because less than 0.03 wt % of M is least effective for increasing coercive force and more than 0.5 wt % of M leads to a decrease in remanence. The amount of M prefer to be 0.05 to 0.5 wt %.

The compositional element described above can be added from compounds or alloys of Fe and Al as the raw materials.

Less than 0.05 wt % of oxygen (O) is not preferable due to the over-sintering and detract from squareness. More than 3.0 wt % of oxygen is not preferable due to the considerable reduction in coercive force and degraded squareness. The amount of oxygen is thus limited to the range of 0.05 to 3.0 wt %. The amount of oxygen prefers to be 0.05 to 1.0 wt %.

Less than 0.01 wt % of carbon (C) is not preferable due to the over-sintering and detract from squareness. More than 0.5 wt % of carbon is not preferable due to the considerable reduction in coercive force and degradation of powder. The amount of carbon is thus limited to the range of 0.01 to 0.5 wt %. The amount of carbon prefers to be 0.02 to 0.3 wt %.

Less than 0.002 wt % of nitrogen (N) is not preferable due to the over-sintering and detract from squareness. More than 0.1 wt % of nitrogen is not preferable because nitrogen has negative impact on sinterability and squareness. The amount of nitrogen is thus limited to the range of 0.002 to 0.1 wt %. The amount of nitrogen prefers to be 0.005 to 0.05 wt %.

Less than 0.001 wt % of fluorine (F) is not preferable due to the abnormal grain growth, the reduction in coercive force and degraded squareness. More than 2.0 wt % of fluorine is undesirable because of a substantial decrease in remanence (Br) and because too large size of the fluorine compound phases bring about some defects in the plating. The amount of fluorine is thus limited to the range of 0.001 to 2.0 wt %. An amount of 0.005 to 1.5 wt % is preferred and an amount of 0.008 to 1.0 wt % is more preferred.

Fluorine can be added by fluorine containing raw materials such as rare earth (R) metals (R is one or more of Nd, Pr, Dy, Tb and Ho), R-T alloy (R is one or more of Nd, Pr, Dy, Tb and Ho, and T is Fe or alloy of Fe and at least one other transitional metal), R-T-B alloys (R is one or more of Nd, Pr, Dy, Tb and Ho), R-T alloy (R is one or more of Nd, Pr, Dy, Tb and Ho, and T is Fe or alloy of Fe and at least one other transitional metal, and B is boron), which is produced by molten salt electrolysis method or calcium thermal reduction method. In other way, fluorine can be also added by mixing with the powder of the rare earth based alloy powder and one or more fluorine compound powder such as $NdF_3$, $PrF_3$, $DyF_3$, $TbF_3$, and $HoF_3$.

In the R—Fe—B base rare earth permanent magnet material of the invention, substituting Co for part of Fe is effective for raising the Curie temperature (Tc). Less than 0.1 wt % of Co is less effective for raising the Curie temperature and thus undesirable. More than 4.5 wt % of Co is economically disadvantageous because of the high price of its raw material. The amount of Co is thus limited to the range of 0.1 to 4.5 wt %. The amount of Co prefers to be 0.2 to 4.3 wt %.

While incidental impurities such as La, Ce, Sm, Y, Ni, Mn, Ca, Mg, Ba, Li, Na, S and P are contained in the raw materials or introduced during the manufacturing process, the presence of such incidental impurities in trace amounts does not compromise the benefits of the invention.

The R—Fe—B base rare earth permanent magnet material of the invention may be prepared by a conventional method. Specifically, it is prepared by a series of steps of casting of an alloy having the above-described composition, coarse grinding, pulverizing, compaction, sintering, and heat treatment at a lower temperature than the sintering temperature.

For example, a permanent magnet material can be obtained by selecting raw materials so as to provide the above-described composition, melting them by such a technique as high-frequency induction melting, and casting the melt. This is followed by coarse grinding on a crusher or Brown mill to an average particle size of about 0.1 mm to about 1 mm, pulverizing by a jet mill in an inert gas atmosphere to an average particle size of about 0.01 μm to about 30 μm, compacting in a magnetic field of 10 to 15 kOe and under a pressure of 1 to 1.5 ton/cm$^2$, sintering in a vacuum atmosphere at 1,000 to 1,200° C., and heat treatment in an argon atmosphere at 400 to 600° C. In the process, the alloy obtained by strip casting method can be also used as the raw materials. The alloy is crushed through the hydrogenise/dehydrogenise treatment, and then which is mixed with the R-rich sintering aid.

EXAMPLE

Examples and Comparative Examples are given below for illustrating the invention although the invention is not limited to the Examples.

Examples 1-5 and Comparative Examples 1-3

The starting raw materials were Nd metal (fluorine contents: 0.0 to 10.0 wt %), Dy metal (fluorine contents: 0.0 to 5.0 wt %), electrolysis iron, Co metal, Ferro-boron, Al, Cu, and Ti. Amount of these materials were determined so as to provide a composition of 30Nd-1Dy-bal.Fe-4Co-1.1B-0.3Al-0.2Cu-0.1Ti-xF (where x is in range of 0.0 to 3.5), in weight ratio, and then melted by the high-frequency induction melting furnace. Thereafter different compositions of the ingots were obtained.

These ingots were then coarsely ground on a Brown mill and pulverized through a jet mill in a nitrogen stream, obtaining fine powder having an average particle size of about 4 μm. Thereafter, the powder was filled in a mold of a compacting machine, oriented in a magnetic field of 10 kOe, and compacted under a pressure of 1 ton/cm$^2$ applied perpendicular to the magnetic field. The compact was sintered at 1,060° C. in a vacuum atmosphere for 2 hours, cooled, and heat treated at 600° C. in an argon atmosphere for one hour, yielding R—Fe—B base rare earth permanent magnet materials of different compositions. These magnet materials contained 0.287 to 0.364 wt % of oxygen, 0.039 to 0.046 wt % of carbon, and 0.008 to 0.016 wt % of nitrogen.

The magnetic properties, such as remanence (Br) and coercive force (iHc) of the thus obtained magnets were measured, as shown in Table 1. It is seen from Table 1 that as long as the amount of fluorine added was up to 1.8 wt %, the coercive force could be increased over the fluorine-free sample at no expense of remanence. When the amount of fluorine added exceeded 1.8 wt %, remanence (Br) substantially decreased.

TABLE 1

| | F added (wt %) | Br (kG) | iHc (kOe) | C (wt %) | O (wt %) | N (wt %) |
|---|---|---|---|---|---|---|
| Comparative Example 1 | nil | 13.02 | 14.97 | 0.040 | 0.340 | 0.014 |
| Example 1 | 0.05 | 13.06 | 15.70 | 0.042 | 0.351 | 0.010 |
| Example 2 | 0.12 | 13.10 | 16.21 | 0.039 | 0.364 | 0.011 |
| Example 3 | 0.56 | 13.11 | 16.08 | 0.040 | 0.301 | 0.008 |
| Example 4 | 1.1 | 13.12 | 15.93 | 0.046 | 0.361 | 0.011 |
| Example 5 | 1.8 | 12.98 | 15.53 | 0.046 | 0.287 | 0.012 |
| Comparative Example 2 | 2.7 | 11.72 | 15.62 | 0.043 | 0.330 | 0.010 |
| Comparative Example 3 | 3.5 | 10.68 | 15.37 | 0.043 | 0.309 | 0.016 |

Example 6

The starting raw materials were Nd metal (fluorine contents: 0.0 to 10.0 wt %), Dy metal (fluorine contents: 0.0 to 5.0 wt %), electrolysis iron, Co metal, Ferro-boron, Al, Cu, and Zr. Amount of these materials were determined so as to provide a composition of 30Nd-1Dy-bal.Fe-4Co-1.1B-0.3Al-0.2Cu-0.1Zr-0.045F, in weight ratio, and then melted by the high-frequency induction melting furnace. Thereafter an ingot indicated above was obtained.

Thereafter, as in Example 1, a R—Fe—B base rare earth permanent magnet material was obtained. The magnet material contained 0.352 wt % of oxygen, 0.039 wt % of carbon, and 0.012 wt % of nitrogen.

Magnetic properties of the obtained magnet were measured, and they showed 13.03 kG in Br, and 16.02 kOe in iHc. The magnet material was sectioned in the magnetization direction and wet polished on the section to a mirror finish. The magnet was immersed in a $HCl/HNO_3/C_2H_5OH$ mixture for one minute for etching away grain boundary phase. The grain size of the remaining primary phase was determined by image analysis on a photomicrograph, obtaining a grain size distribution as shown in FIG. 1. The magnet had an average grain size of 6.28 μm and a sharp grain size distribution. It is confirmed to contribute the stabilization of manufacture process.

Comparative Example 4

The starting raw materials were Nd metal (fluorine contents: less than 0.005 wt %), Dy metal (fluorine contents: less than 0.005 wt %), electrolysis iron, Co metal, Ferro-boron, Al, Cu, and Zr. Amount of these materials were determined so as to provide a composition of 30Nd-1Dy-bal.Fe-4Co-1.1B-0.3Al-0.2Cu-0.1Zr-xF (x is less than 0.001), in weight ratio, and then melted by the high-frequency induction melting furnace. Thereafter an ingot indicated above was obtained.

Then, as in Example 1, a R—Fe—B base rare earth permanent magnet material was obtained. The magnet material contained 0.384 wt % of oxygen, 0.041 wt % of carbon, and 0.013 wt % of nitrogen.

Figure 2:
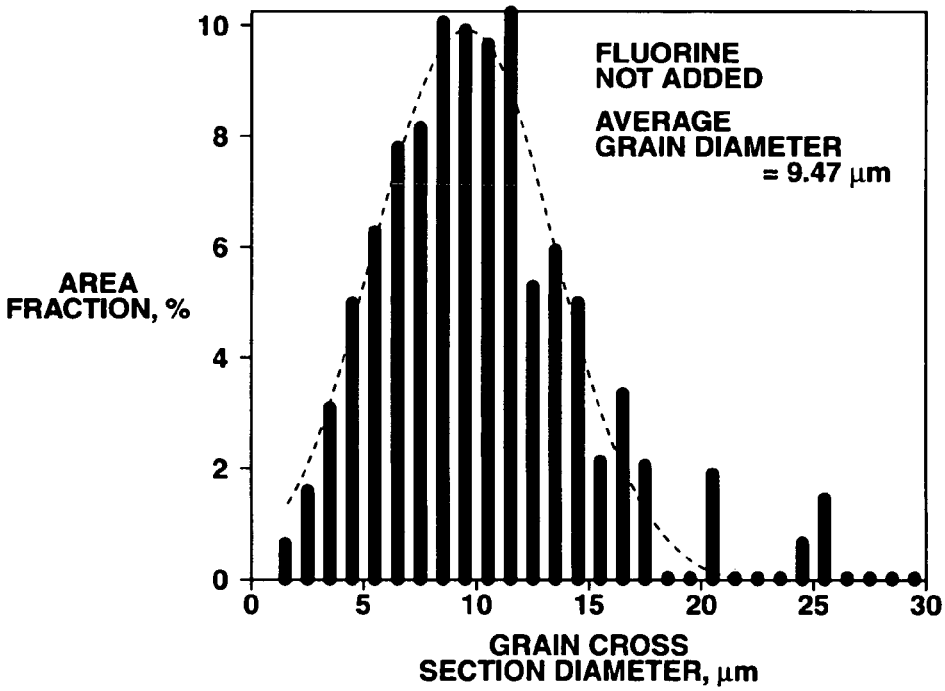
FIG. 2 is a diagram showing the grain size distribution of a fluorine-free R—Fe—B base magnet.

The thus obtained magnet material was measured for remanence (Br) and coercive force (iHc), finding magnetic properties including Br=12.98 kG and iHc=14.62 kOe. The grain size distribution of this magnet material was determined by the same method as in Example 6, with the results shown in FIG. 2. The magnet had an average grain size of 9.47 μm, indicating the abnormally grown grains with a diameter of more than 20 μm.

Figure 3:
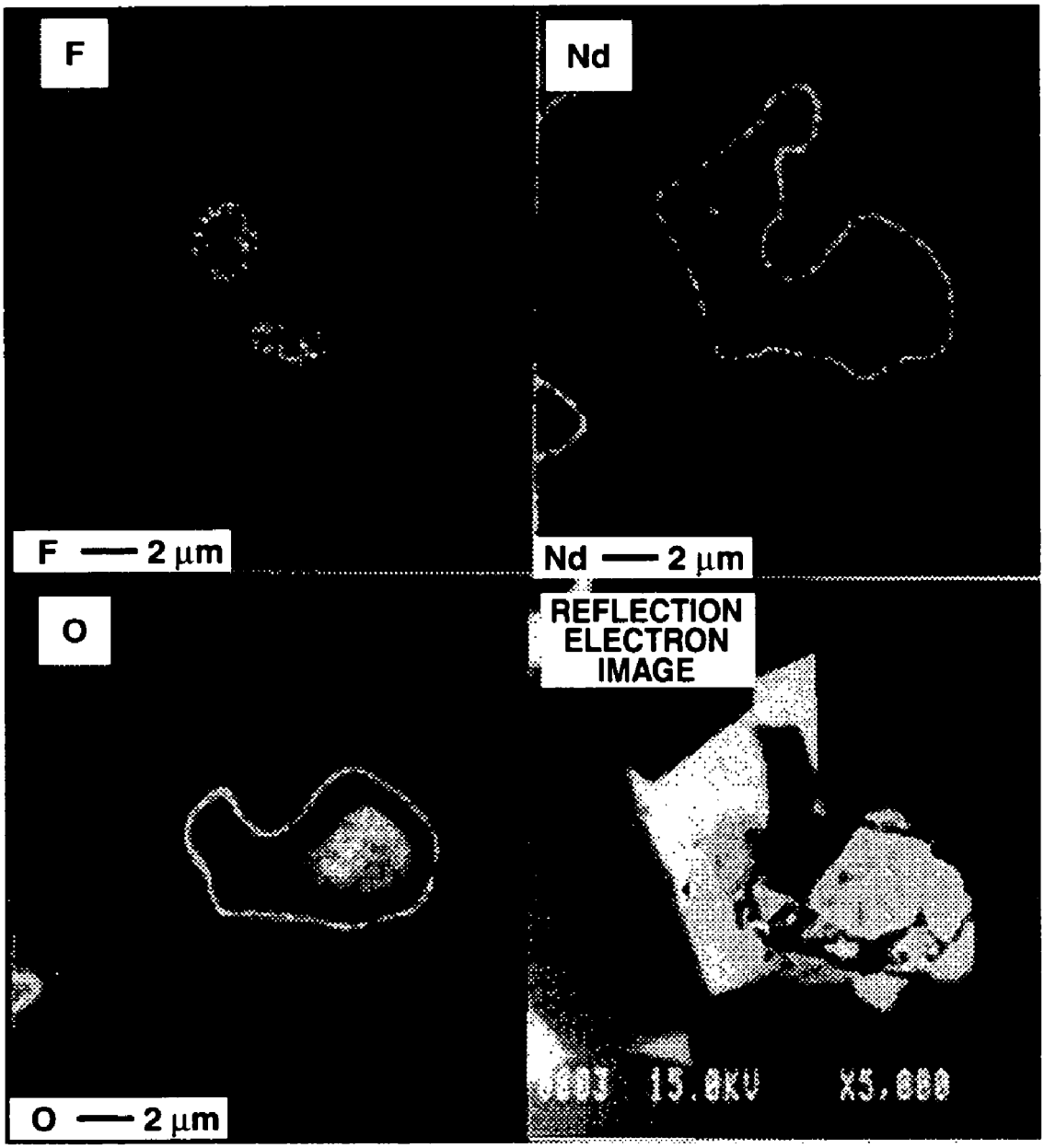
FIG. 3 includes a book scatter electron image of a rare earth permanent magnet and compositional profiles of Nd, oxygen and fluorine.

By electron probe microanalysis (EPMA), the magnet material obtained in Example 6 was analyzed for Nd, fluorine and oxygen profiles and back scatter electron image, with the results shown in FIG. 3. It is seen from FIG. 3 that fluorine is localized at grain boundaries as the Nd—O—F compound.

Examples 7-10 and Comparative Examples 5-7

The starting raw materials were Nd metal (fluorine contents: 0.0 to 10.0 wt %), Dy metal (fluorine contents: 0.0 to 5.0 wt %), electrolysis iron, Co metal, Ferro-boron, Al, Cu, and Zr. Amount of these materials were determined so as to provide a composition of 30Nd-1Dy-bal.Fe-4Co-1.1B-0.3Al-0.2Cu-0.1Zr-xF (where x is in the range of 0.03 to 3.3), in weight ratio, and then melted by the high-frequency induction melting furnace. Thereafter an ingot indicated above was obtained.

Then, as in Example 1, a R—Fe—B base rare earth permanent magnet material was obtained. The magnet material contained 0.261 to 0.352 wt % of oxygen, 0.041 to 0.046 wt % of carbon, and 0.008 to 0.015 wt % of nitrogen.

Each magnet material was worked into a shape of 5×5×2 mm, plated with nickel, and subjected to a corrosion test under the following conditions, after which its outer appearance was observed.

Immersion liquid: 5% NaCl in water

Temperature: 35° C.

Time: 24 hours

The results are shown in Table 2. Marked degradation of plating occurred when the amount of fluorine added was equal to or more than 2.6 wt %.

TABLE 2

| | F added (wt %) | Appearance after test | C (wt %) | O (wt %) | N (wt %) |
|---|---|---|---|---|---|
| Example 7 | 0.03 | excellent | 0.044 | 0.286 | 0.012 |
| Example 8 | 0.56 | excellent | 0.042 | 0.330 | 0.010 |
| Example 9 | 1.2 | excellent | 0.046 | 0.307 | 0.011 |
| Example 10 | 1.9 | good | 0.043 | 0.356 | 0.008 |
| Comparative Example 5 | 2.6 | pinholes | 0.043 | 0.290 | 0.012 |
| Comparative Example 6 | 2.8 | pinholes | 0.041 | 0.292 | 0.013 |
| Comparative Example 7 | 3.3 | plating peeled | 0.044 | 0.261 | 0.015 |

Examples 11-14 and Comparative Examples 8-10

The starting raw materials were Nd metal (fluorine contents: less than 0.001 wt %), Dy metal (fluorine contents: less than 0.002 wt %), electrolysis iron, Co metal, Ferro-boron, Al, Cu, and Zr. Amount of these materials were determined so as to provide a composition of 29Nd-2Dy-bal.Fe-4Co-1.1B-0.3Al-0.2Cu0.1Zr, in weight ratio, and then melted by the high-frequency induction melting furnace. After that, the ingot of above indicated was obtained. The ingot was coarsely crushed by the Brown mill, and then coarse powder was mixed $NdF_3$ powder so as to provide a fluorine concentration of 0.04 to 4.1% in weight. After that, the mixed powder was pulverized through a jet mill in a nitrogen stream, and fine powder with an average particle size of about 4.3 μm was obtained. R—Fe—B base rare earth permanent magnet materials with various compositions were obtained by the same process as these magnet materials was obtained. The magnet material contained 0.352 to 0.432 wt % of oxygen, 0.043 to 0.050 wt % of carbon, and 0.009 to 0.020 wt % of nitrogen.

The thus obtained magnet materials were measured for remanence (Br) and coercive force (iHc), with the results shown in Table 3. It is seen from Table 3 that as long as the amount of fluorine added was up to 1.6 wt %, the coercive force could be increased over the fluorine-free sample without a substantial decrease in remanence. When the amount of fluorine added exceeded 4.1 wt %, the coercive force decreased rather than that of the fluorine-free sample. Particularly when the amount of fluorine added was 0.8 wt %, the coercive force increased by about 1.3 kOe than that of the fluorine-free sample.

TABLE 3

| | F added (wt %) | Br (kG) | iHc (kOe) | C (wt %) | O (wt %) | N (wt %) |
|---|---|---|---|---|---|---|
| Comparative Example 8 | nil | 12.76 | 16.02 | 0.044 | 0.407 | 0.010 |
| Example 11 | 0.04 | 12.80 | 16.81 | 0.043 | 0.432 | 0.009 |
| Example 12 | 0.8 | 12.73 | 17.34 | 0.044 | 0.366 | 0.013 |
| Example 13 | 1.3 | 12.60 | 17.21 | 0.046 | 0.408 | 0.011 |
| Example 14 | 1.6 | 12.54 | 17.05 | 0.045 | 0.426 | 0.009 |
| Comparative Example 9 | 3.6 | 10.51 | 16.75 | 0.047 | 0.374 | 0.015 |
| Comparative Example 10 | 4.1 | 8.08 | 14.38 | 0.050 | 0.352 | 0.020 |

The invention claimed is:

1. A R—Fe—B base rare earth permanent magnet material consisting of, in percents by weight, R 25 to 45 wt %, Co 0.1 to 4.5 wt %, B 0.8 to 1.4 wt %, Al 0.05 to 3.0 wt %, Cu 0.02 to 0.5 wt %, M 0.03 to 0.5 wt %, C 0.01 to 0.5 wt %, O 0.05 to 3.0 wt %, N 0.002 to 0.1 wt %, F 0.001 to 2.0 wt %, with the balance of Fe and incidental impurities, wherein R is at least one element selected from the group consisting of Nd, Pr, Dy, Tb and Ho, and M is at least one element selected from the group consisting of Zr, Hf, Ti, Nb, Mo, Si, Sn, Zn, V, W and Cr, said magnet material comprising a R—O—F compound which is localized at triple points in the magnet.

2. The R—Fe—B base rare earth permanent magnet material of claim 1, having a F content of 0.005 to 1.5 wt %.

3. The R—Fe—B base rare earth permanent magnet material of claim 2, having a F content of 0.008 to 1.0 wt %.

4. The R—Fe—B base rare earth permanent magnet material of claim 1, having a F content of 0.03 to 1.9 wt %.

5. The R—Fe—B base rare earth permanent magnet material of claim 1, having a F content of 0.12 to 1.2 wt %.

6. The R—Fe—B base rare earth permanent magnet material of claim 1, having a N content of 0.008 to 0.1 wt %.

* * * * *